US006715699B1

(12) United States Patent
Greenberg et al.

(10) Patent No.: US 6,715,699 B1
(45) Date of Patent: Apr. 6, 2004

(54) SHOWERHEAD ENGINE ASSEMBLY

(75) Inventors: Ilan Greenberg, Haifa (IL); Moty Lev, Lexington, KY (US); Amir Genosar, Migdal HaEmek (IL); John E. Petrovic, Hillsdale, MI (US)

(73) Assignee: Masco Corporation, Taylor, MI (US)

( * ) Notice: Subject to any disclaimer, the term of this patent is extended or adjusted under 35 U.S.C. 154(b) by 0 days.

(21) Appl. No.: 09/518,668

(22) Filed: Mar. 3, 2000

Related U.S. Application Data

(60) Provisional application No. 60/128,289, filed on Apr. 8, 1999.

(51) Int. Cl.[7] ..... A62C 31/02

(52) U.S. Cl. ..... 239/394; 239/383; 239/443; 239/447

(58) Field of Search ..... 239/380–383, 239/390–394, 443–447

(56) References Cited

U.S. PATENT DOCUMENTS

| | | | | | |
|---|---|---|---|---|---|
| 4,101,075 | A | * | 7/1978 | Heitzman | 239/447 |
| 4,204,646 | A | * | 5/1980 | Shames et al. | 239/443 |
| 4,324,364 | A | * | 4/1982 | Buzzi et al. | 239/381 |
| 4,579,284 | A | * | 4/1986 | Arnold | 239/381 |
| 4,703,893 | A | | 11/1987 | Gruber | |
| 4,754,928 | A | * | 7/1988 | Rogers et al. | 239/381 |
| 4,838,486 | A | | 6/1989 | Finkbeiner | |
| 5,215,258 | A | * | 6/1993 | Jursich | 239/394 |
| 5,246,169 | A | | 9/1993 | Heimann et al. | |
| 5,833,138 | A | | 11/1998 | Crane et al. | |
| 5,918,816 | A | * | 7/1999 | Huber | 239/391 |

FOREIGN PATENT DOCUMENTS

| | | |
|---|---|---|
| EP | 0697251 | 2/1996 |
| EP | 0697251 | 11/1996 |
| EP | 0938928 | 9/1999 |
| WO | WO92/0230 | 2/1992 |

* cited by examiner

*Primary Examiner*—Christopher Kim
(74) *Attorney, Agent, or Firm*—Carlson, Gaskey & Olds

(57) ABSTRACT

The showerhead engine assemblies provide different combinations and variations of continuous, deflected, pulsating sprays, and aeration spray patterns including those that are adjustable enabling wide variations in the degree of aeration of the water passing through the showerhead, enabling wide variation of the characteristics of the water spray patterns. The spray patterns include a nondeflected, nonpulsating spray pattern; a deflected nonpulsating spray pattern; a nondeflected, pulsating spray pattern; and a deflected, pulsating spray pattern, while enabling the engine assembly to be self-cleaning. For pulsating spray modes, the showerhead engine assembly includes but five plastic parts and an O-ring seal; the parts being a stator, a spinner, an engager, a pressure plate, and a faceplate, openings beings disposed in the pressure plate and faceplate to enable fluid flow therefrom. Deflecting surfaces on the faceplate enable a variety of different flow patterns. Spinner rotation starts or stops depending upon the position of the spinner relative to the stator, since the stator includes a pair of stop flanges that engage and disengage with the spinner. When the spinner is disengaged and free to rotate, water flow through passages in the spinner cause spinner rotation, creating a vortex and pulsating spray patterns. The series of showerhead engine assemblies include component parts that are interchangeable, the number of component parts being minimal, the interchangeability reducing the number of spare parts necessary to repair the series of showerhead engine assemblies.

14 Claims, 15 Drawing Sheets

SHOWERHEAD ENGINE ASSEMBLY

RELATED APPLICATIONS

Figure 1:
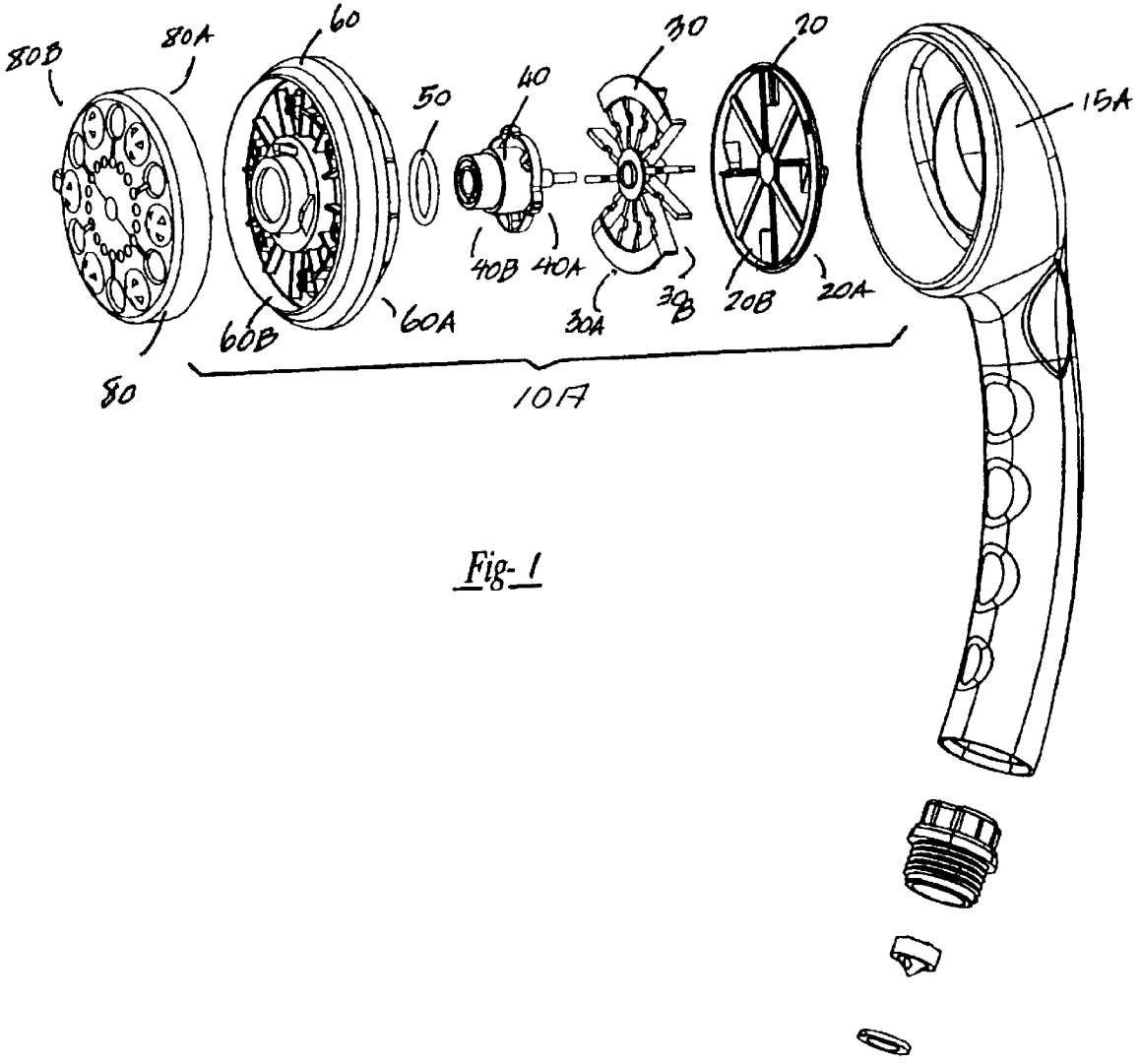

This application claims priority from U.S. Provisional Application No. 60/128,289 filed on Apr. 8, 1999.

FIELD OF ART

This invention relates to showerhead engine assemblies and water aerators, and more particularly, to showerhead engine assemblies having different combinations of continuous and pulsating sprays.

BACKGROUND OF THE INVENTION

Numerous showerheads assemblies are known in the prior art that operate in multi-functional modes. These assemblies provide fixed spray patterns in combination with massaging action generated by either pulsating or whirling the water through the showerhead. Individual systems include:

(1) A selector disk removably and rotatably mounted inside the selector housing. The disk selector has an inlet end facing the inlet end of the selector housing, and an outlet end opposite the inlet end of the disk selector. The showerhead includes a selector face mounted inside the selector housing and a diffuser plate mounted inside the selector housing.

(2) A showerhead assembly enabling the selection of various forms of output streams, including a set of streams having a large diameter, rich in bubbles when the water pressure is high, a set of streams having a smaller diameter full of bubbles when the water pressure is low, or a spray instead of the bubbly stream.

(3) A showering system fed from a source of hot water that produces steam. A selectively controlled diverter is disposed within the conduit and diverts the water arriving from the source away from the showerhead and through the outlet in the form of a mist. The showerhead includes a nozzle-driven turbine. Apertures in a flow director plate, governed by a control plate, feed nozzles predetermined to vary the force of water delivered. The water force varies with the number of the nozzles that are open.

These systems have complex internal components which must be sealed relative to each other, are relatively expensive to produce, and due to the complexity of the components often do not operate in a manner which fully prevents leakage during use. In addition, the showerhead outlet ports often become obstructed by impurities causing almost random spray patterns.

What is needed is a showering system that overcomes the disadvantages of the prior art, that is economical to manufacture and durable in use, that operates effectively within a wide range of water pressures, that enables the person to select from a regular continuous spray, an aerated spray, a pulsating spray, and several combinations thereof, and that is energy efficient and yields spray characteristics that are better than conventional showerhead engine assemblies.

What is needed is a showerhead engine assembly having component parts that are interchangeable with other assemblies, the number of component parts being minimal, the interchangeability reducing the number of spare parts necessary for repair purposes, the assembly enabling various combination of spray patterns including jet spray, aeration, deflected spray, pulsating jet spray, and pulsating deflected spray, while providing self-cleaning convenience.

SUMMARY OF THE INVENTION

These needs are addressed by the preferred embodiments of the showerhead engine assemblies of the present invention. The term showerhead as used herein designates any device which attaches to a shower fluid supply through an inlet tube and creates a spray by changing the fluid pattern, including (1) standard showerheads, (2) pulsating showerheads, and (3) energy-savings, aerating showerheads.

In a first preferred embodiment of the showerhead engine assembly of the present invention comprises five plastic parts plus an O-ring seal; the parts being a stator, a spinner, an engager, a pressure plate, and a faceplate, openings beings disposed in the pressure plate and faceplate to enable fluid flow therethrough. Deflecting surfaces on the faceplate enable a variety of different flow patterns. Rotation of the spinner is dependant upon the particular spray pattern selected. The stator includes a pair of stop flanges that engage and disengage with the spinner. When the spinner is disengaged and free to rotate, fluid flow through passages in the spinner cause spinner rotation, creating a vortex. When the spinner is free to rotate, the combination of the spinner, stator, and pressure plate create pulsating action.

The spray patterns are formed external to the pressure chamber. The spray selection occurs on more than one plane, between the pressure plate and the faceplate, and the spray selection occurs with water at atmospheric pressure. The spray patterns are created by the deflecting surfaces disposed on the faceplate. Four basic spray patterns: (1) nonpulsating uninterrupted flow where the spinner is stationary; (2) nonpulsating deflected flow where the spinner is also stationary; (3) pulsating uninterrupted flow where the spinner is rotating; and (4) pulsating deflected flow where the spinner is rotating.

In a second preferred embodiment of the showerhead engine assembly of the present invention, the engine assembly comprises only a pressure plate and a faceplate, without pulsation. A mechanism for alignment purposes is preferably incorporated into the pressure plate and faceplate, since unless properly aligned, the water flow becomes random. Also, a detente mechanism can be used. The faceplate is identical to the faceplate in the first preferred embodiment. Two spray patterns are available: (1) nonpulsating uninterrupted flow; and (2) nonpulsating deflected flow.

The pressure chamber within the showerhead engine assembly disposed between the stator and the pressure plate must be sealed from the spray selection chamber. In contrast to conventional showerhead engine assemblies where high-pressure seals are needed to provide necessary sealing, the showerhead engine assembly of the present invention only needs to seal the pressure chamber from the spray selection chamber.

Additional embodiments include showerhead engine assemblies similar to the first and second preferred embodiments that include a self-cleaning action. Six self-cleaning pins disposed are normal to the plane of the spring wire. The circular spring nests in a circular slot in the pressure plate. Each of the six orifice holes in the pressure plate comprise a cluster of apertures disposed about a central opening. The pins rest into each of the central openings. As the relative position of the faceplate is rotated about the pressure plate-spring combination as spray selections are made, the edges of the faceplate force the pins to move back and forth axially within the central openings generating the self-cleaning action. The pins translate within the holes by the action of rotation of the shower faceplate itself, resulting in the self-cleaning action.

The advantages of the showerhead engine assembly of the present invention are numerous. These advantages include spray patterns formed external to the pressure chamber; and a dramatic reduction in the number of component parts, which keeps part count down, improves assembly time, reduces costs, and simplifies repair. The showerhead engine assembly of the present invention also provides crossing spray patterns; and families of showerhead engine assemblies that provide various spray patterns with interchangeable component parts. Other shaped and sized orifices in the faceplate enable a selection of a variety of spray patterns with varying spray characteristics. Rotation and realignment of the faceplate relative to the pressure plate changes the orifice configurations and the number of spray selection options.

For a more complete understanding of the showerhead engine assembly of the present invention, reference is made to the following detailed description and accompanying drawings in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

DETAILED DESCRIPTION OF THE DRAWINGS

Figure 2A:
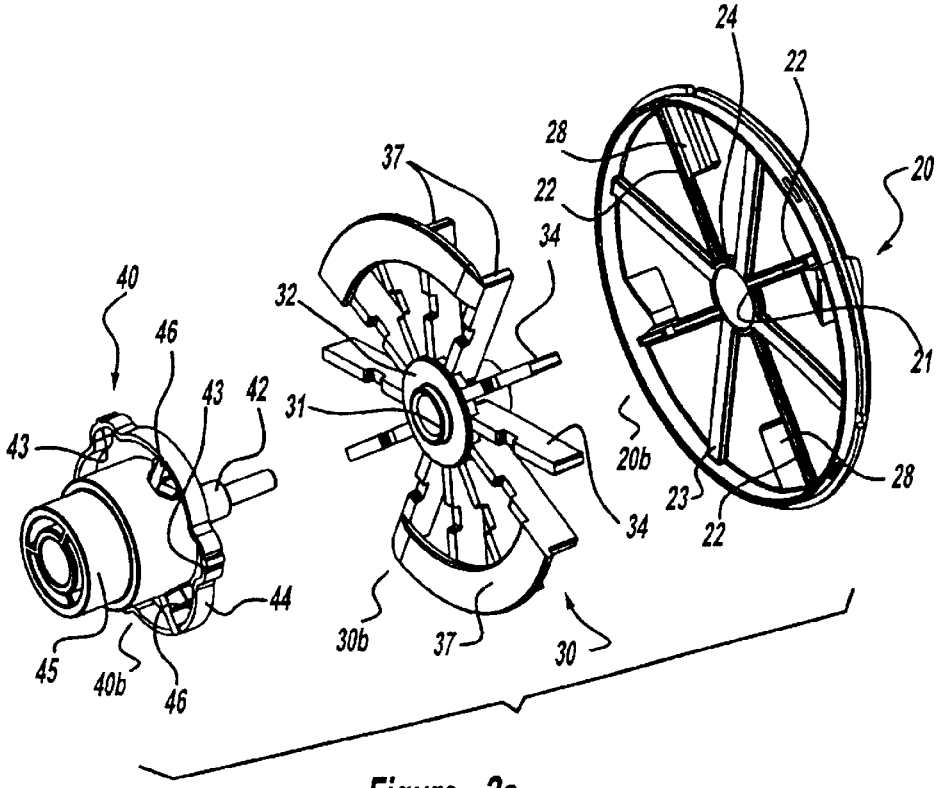
Figure 2B:
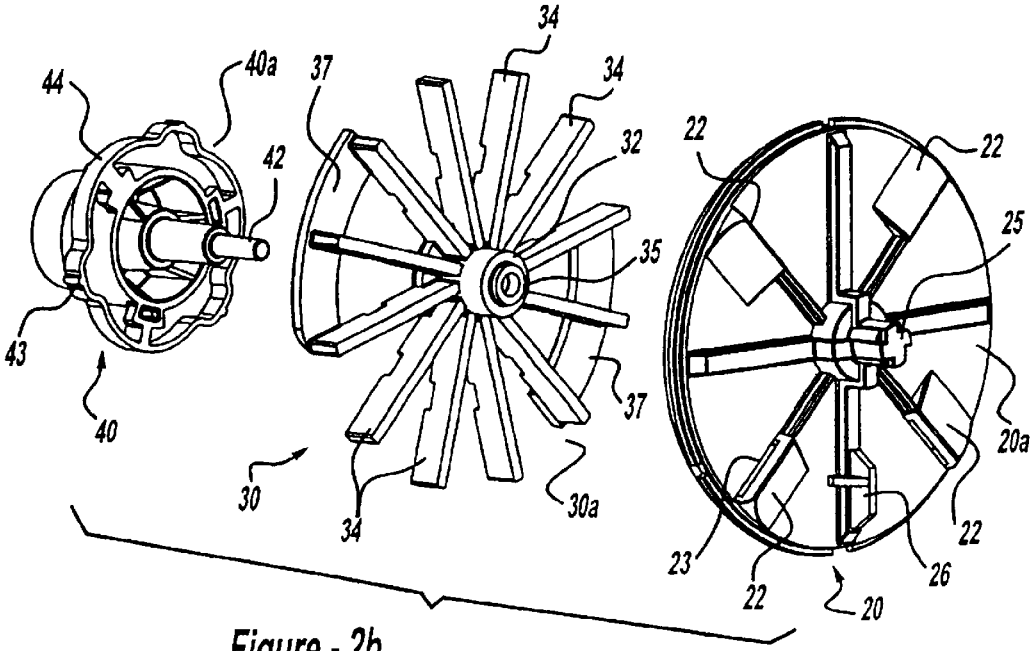
Figure 3A:
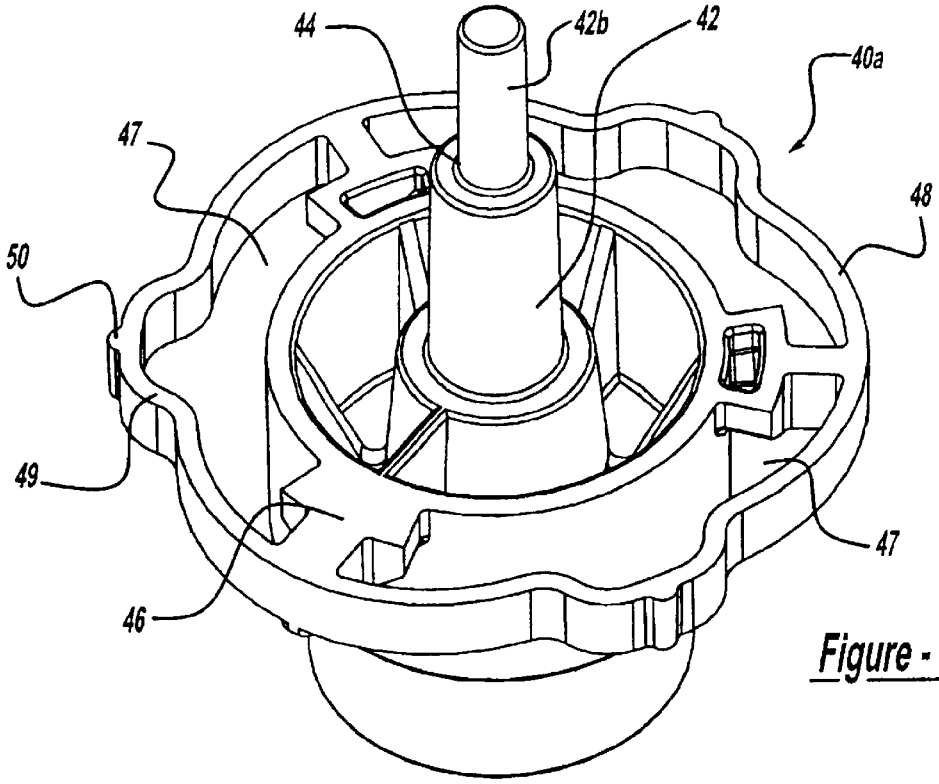
Figure 3B:
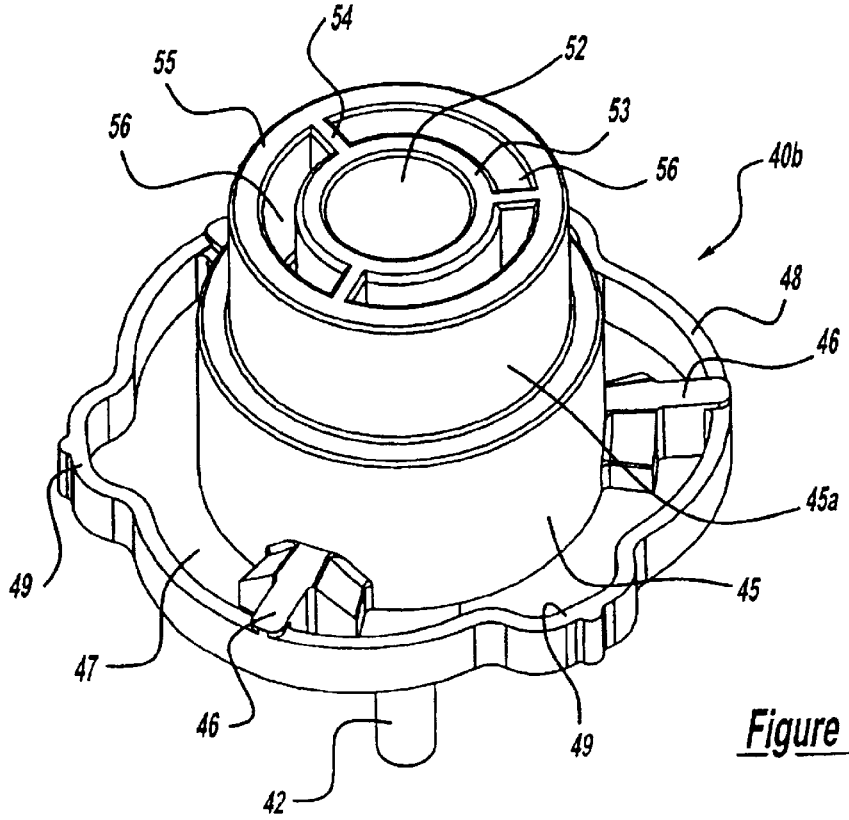
Figure 4A:
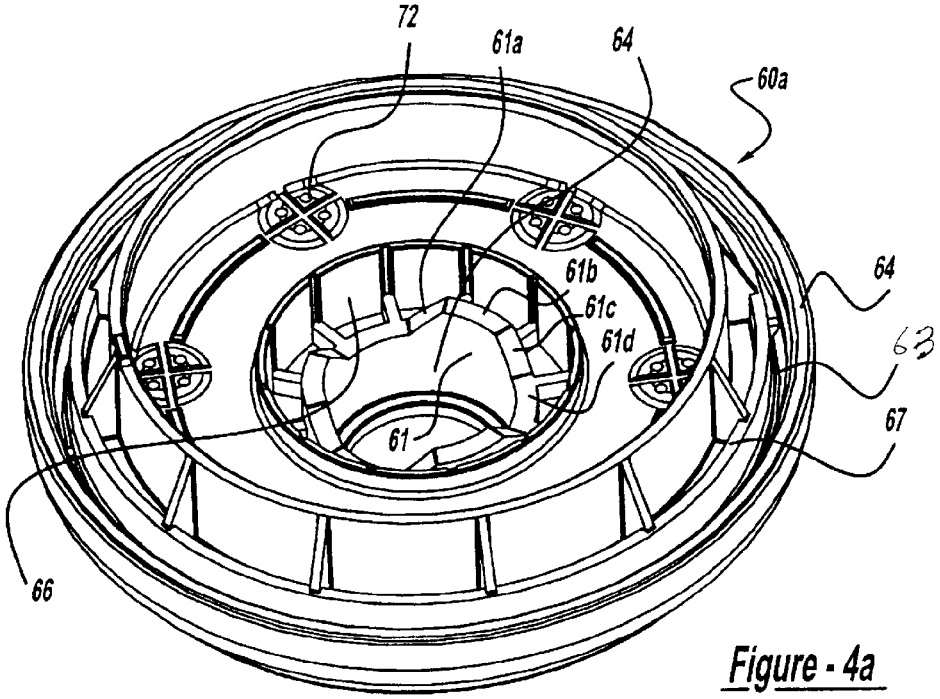
Figure 4B:
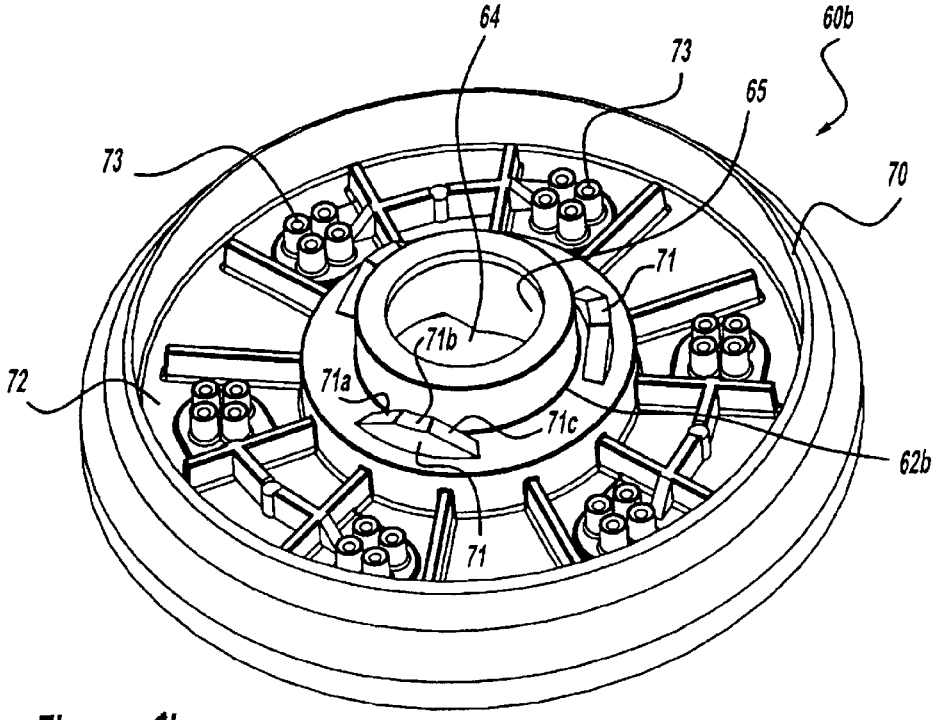
Figure 5A:
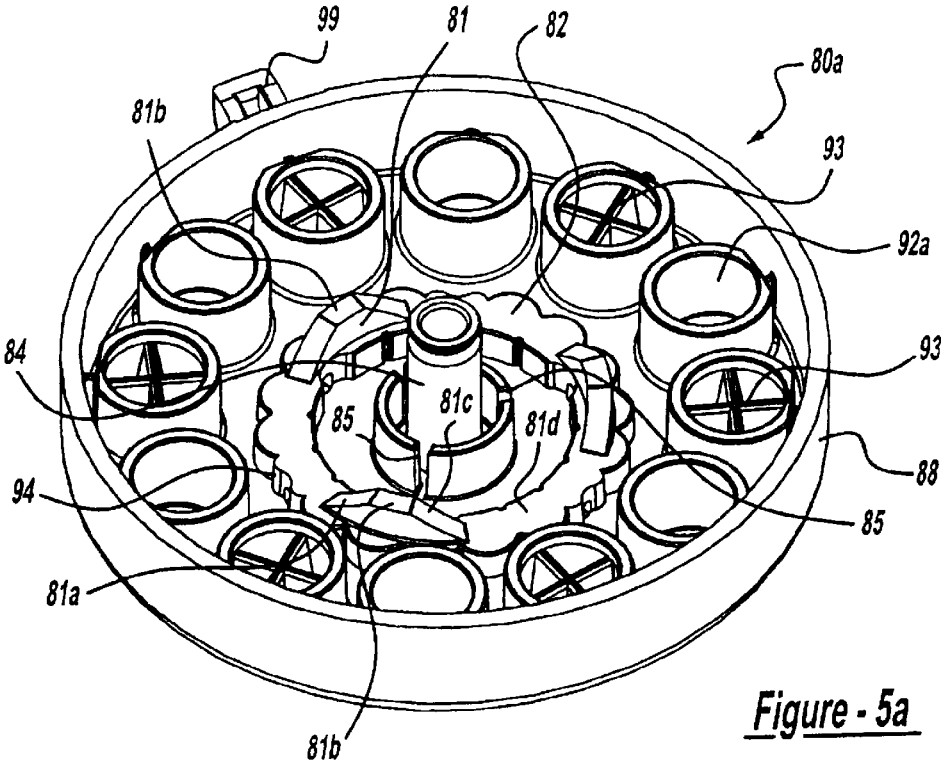
Figure 5B:
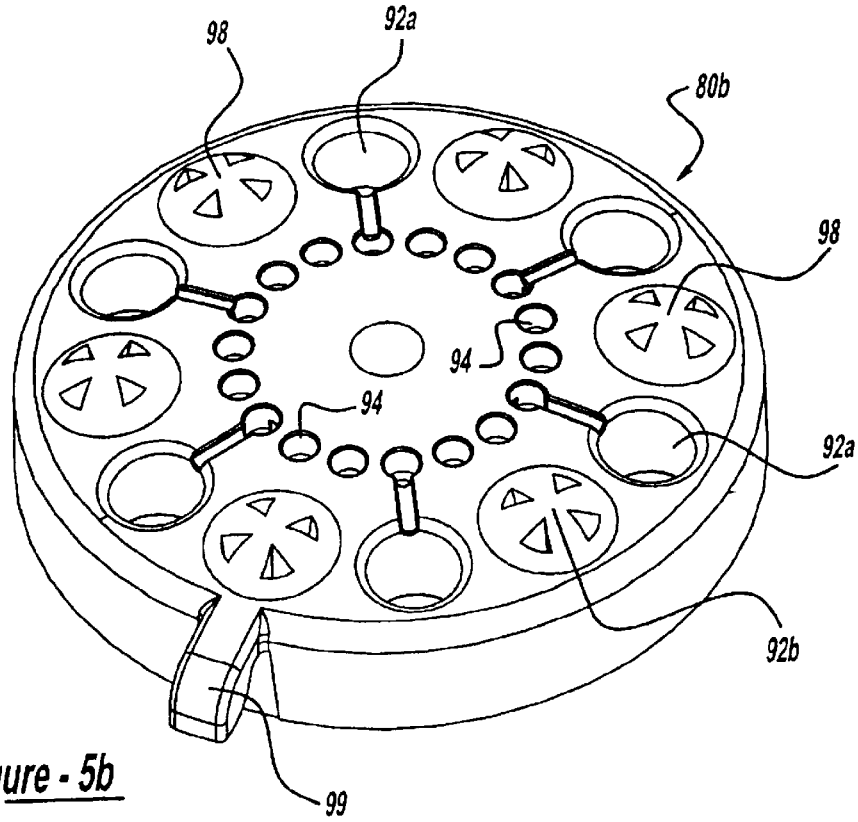
Figure 6:
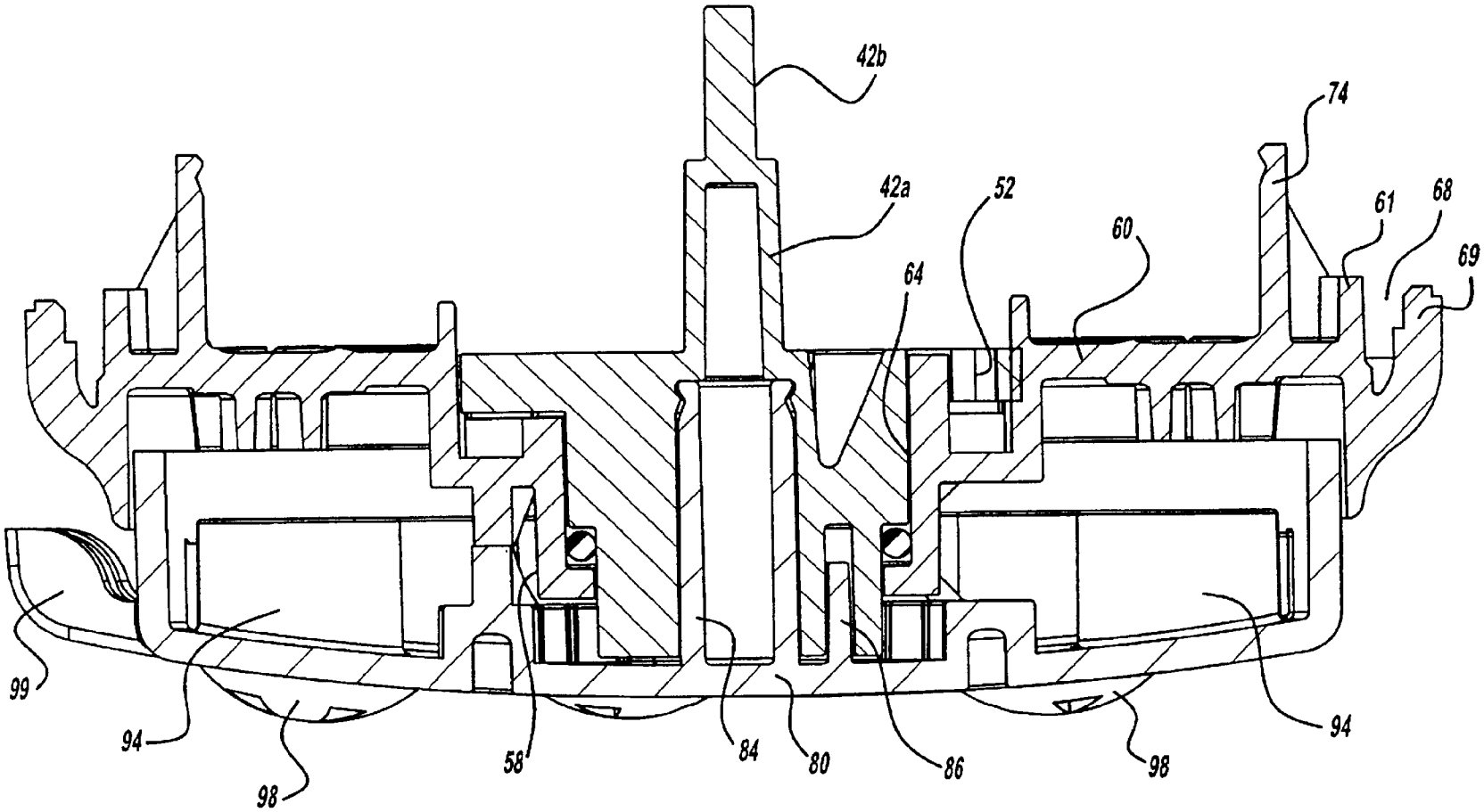
Figure 7A:
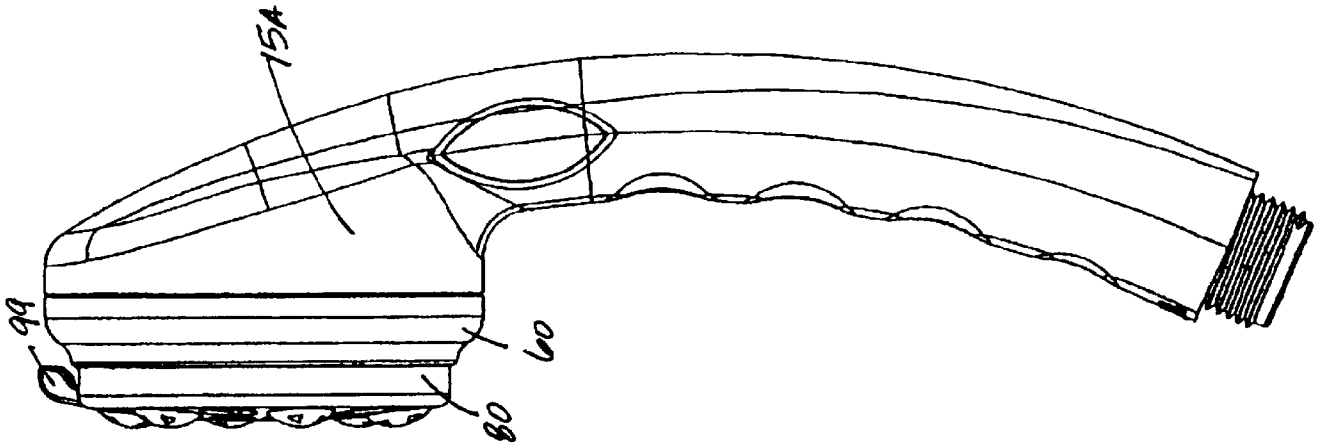
Figure 7B:
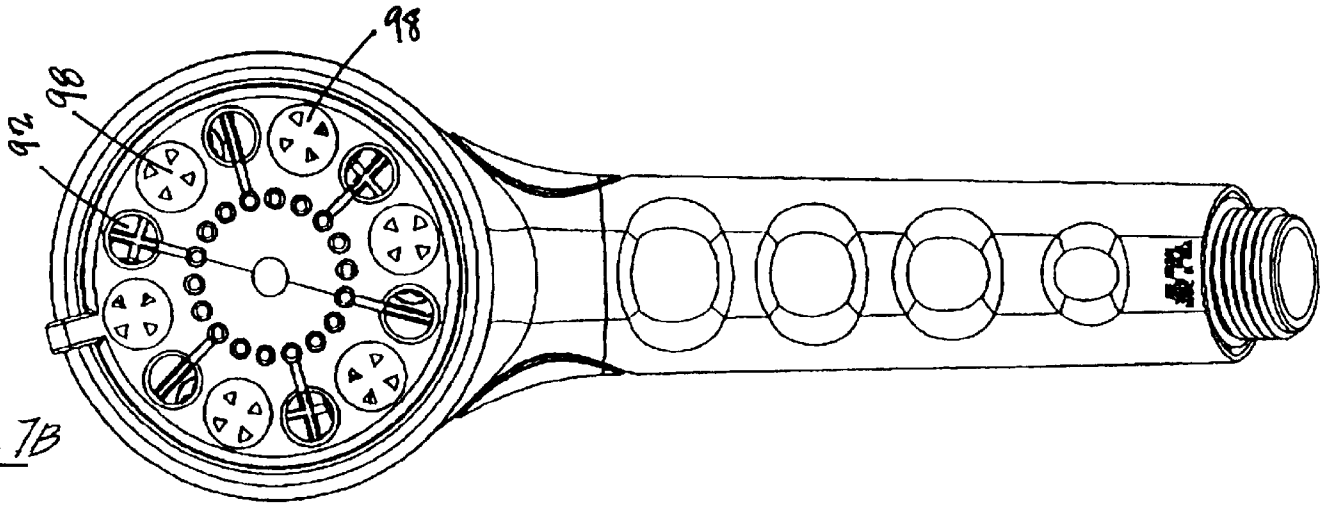
Figure 8A:
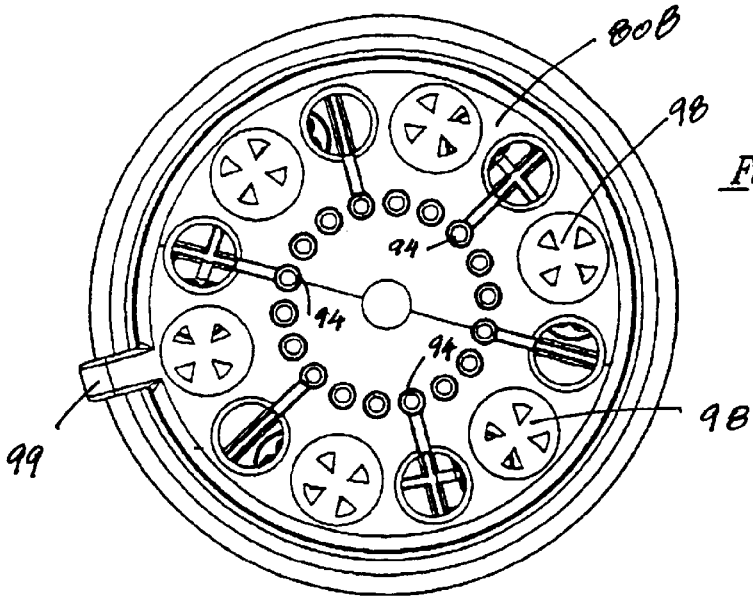
Figure 8B:
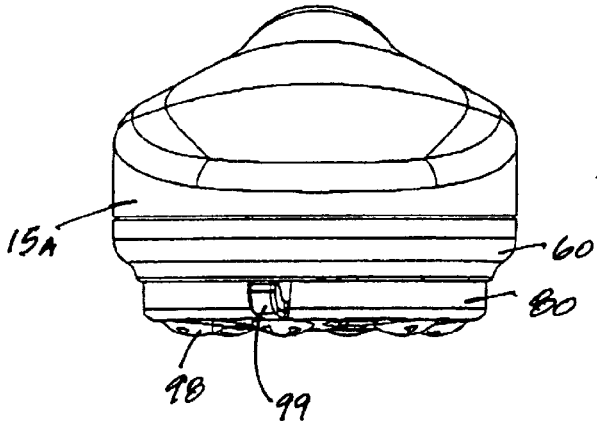
Figure 8C:
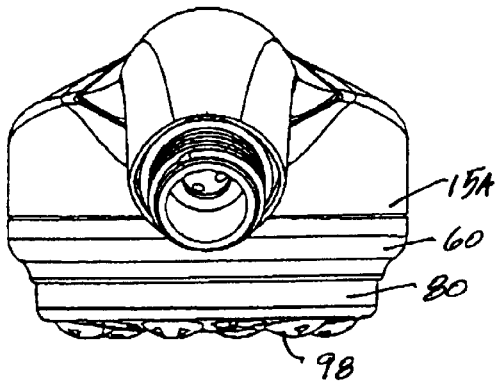
Figure 9:
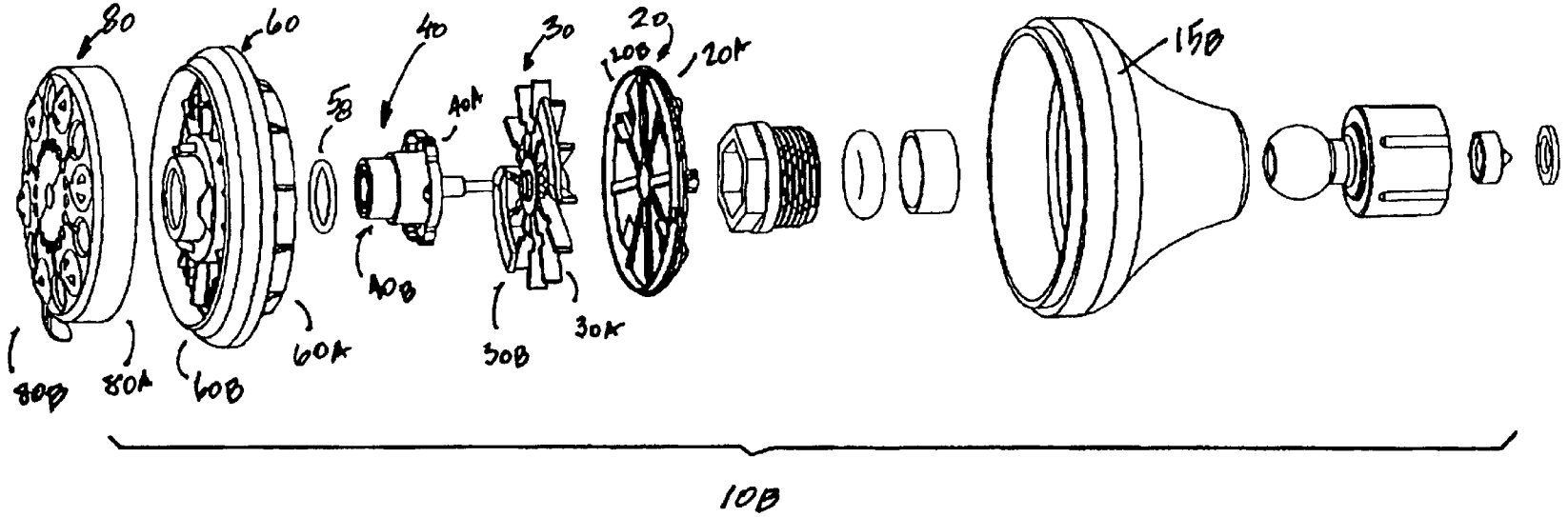
Figure 10A:
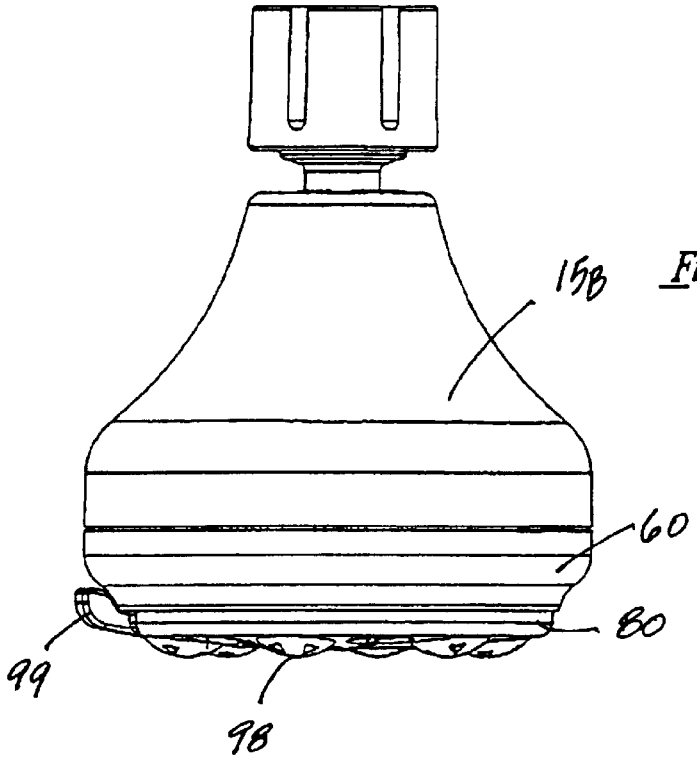
Figure 10B:
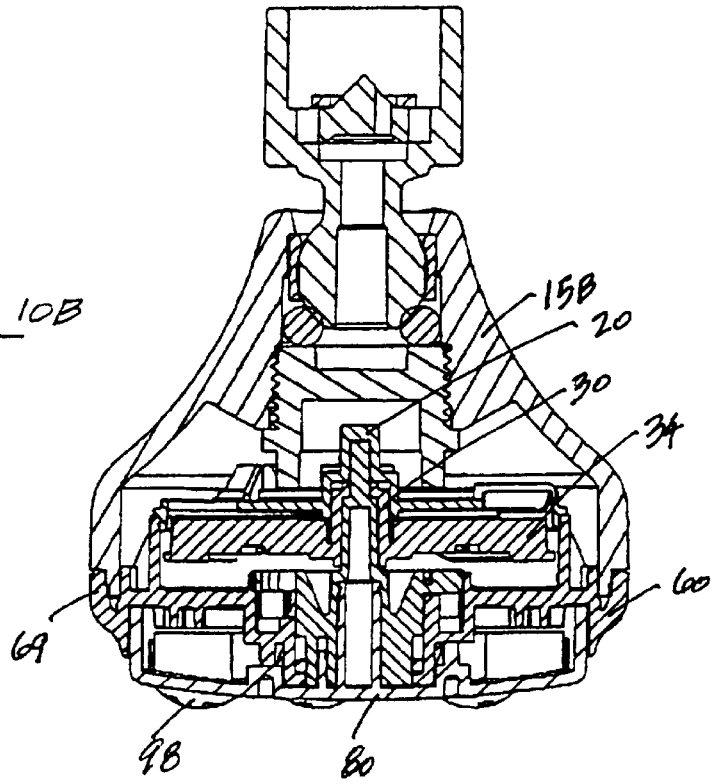
Figure 11A:
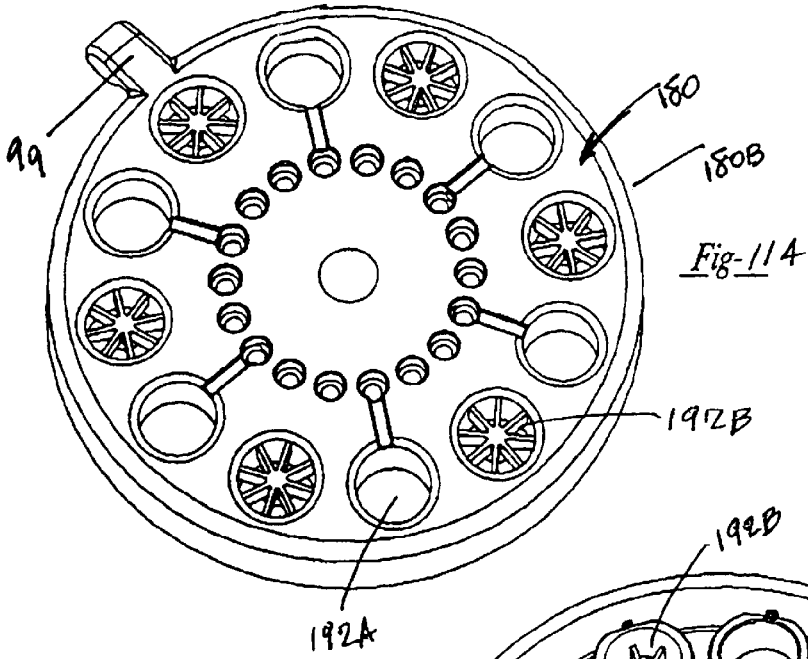
Figure 11B:
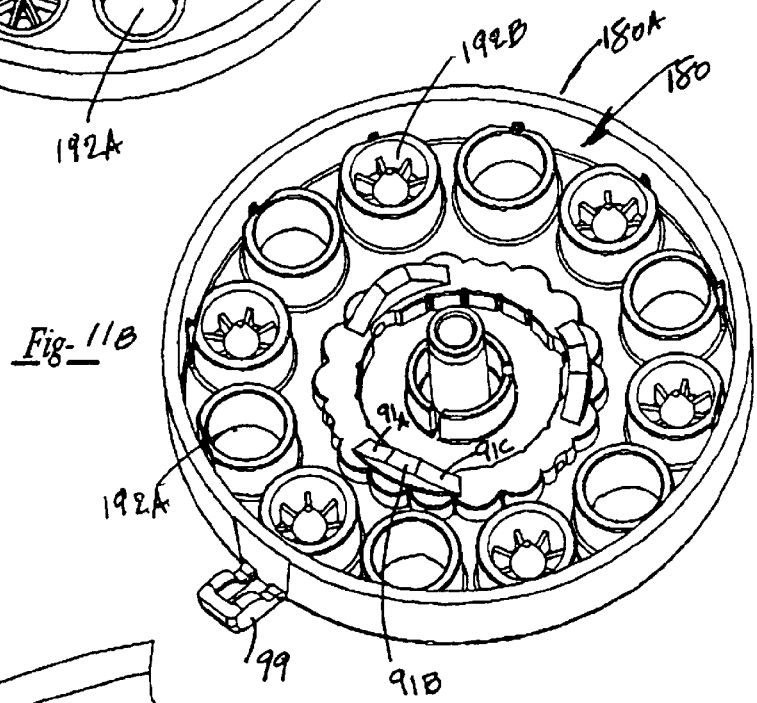
Figure 11C:
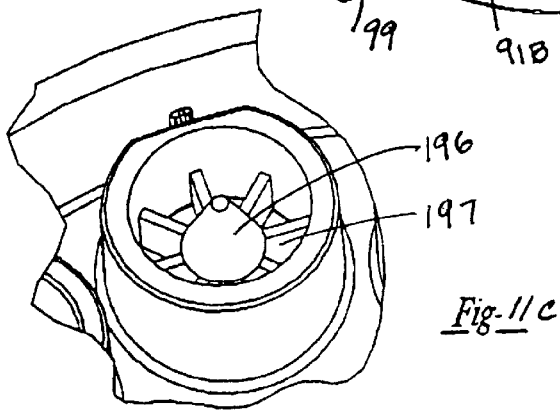
Figure 12A:
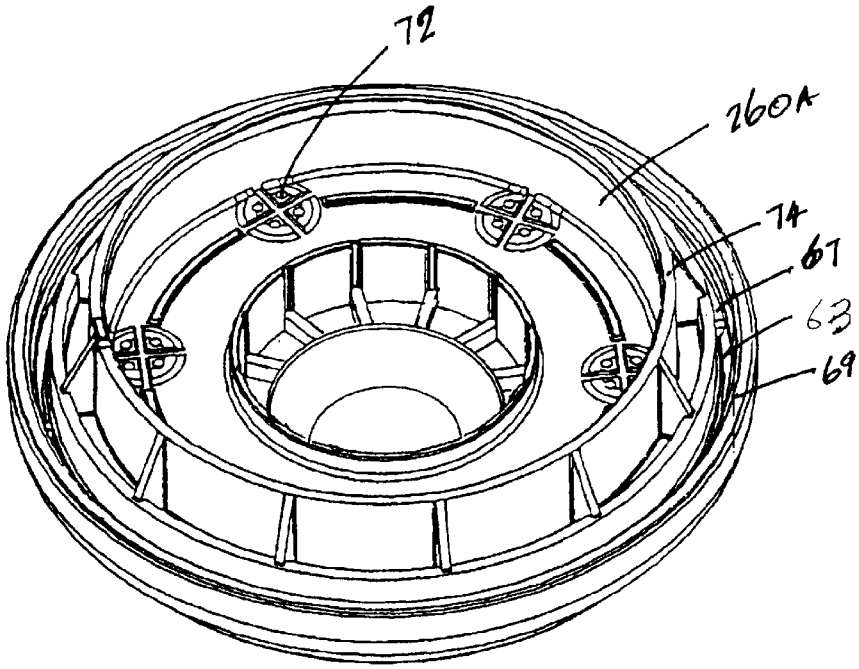
Figure 12B:
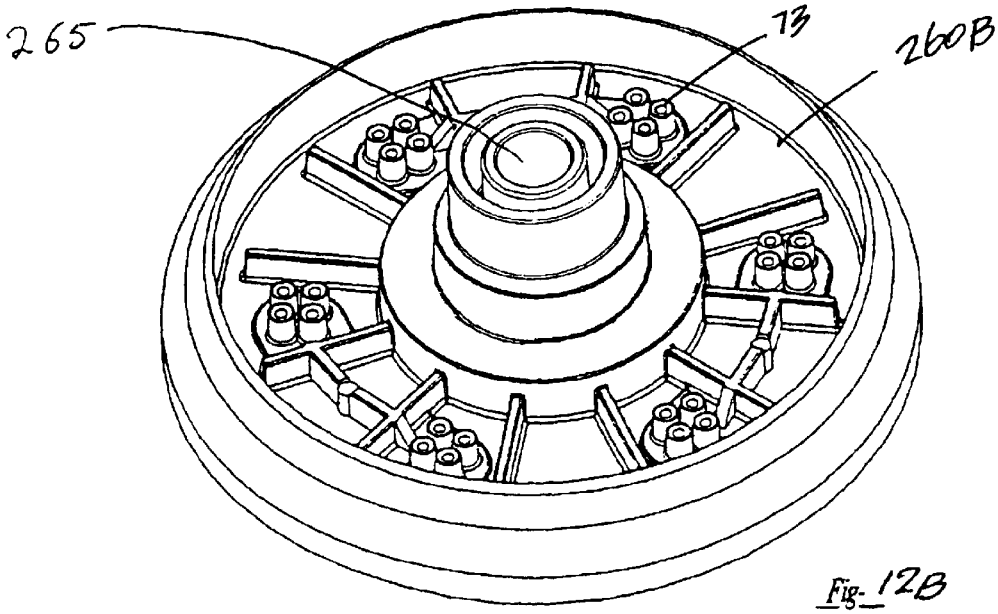
Figure 13:
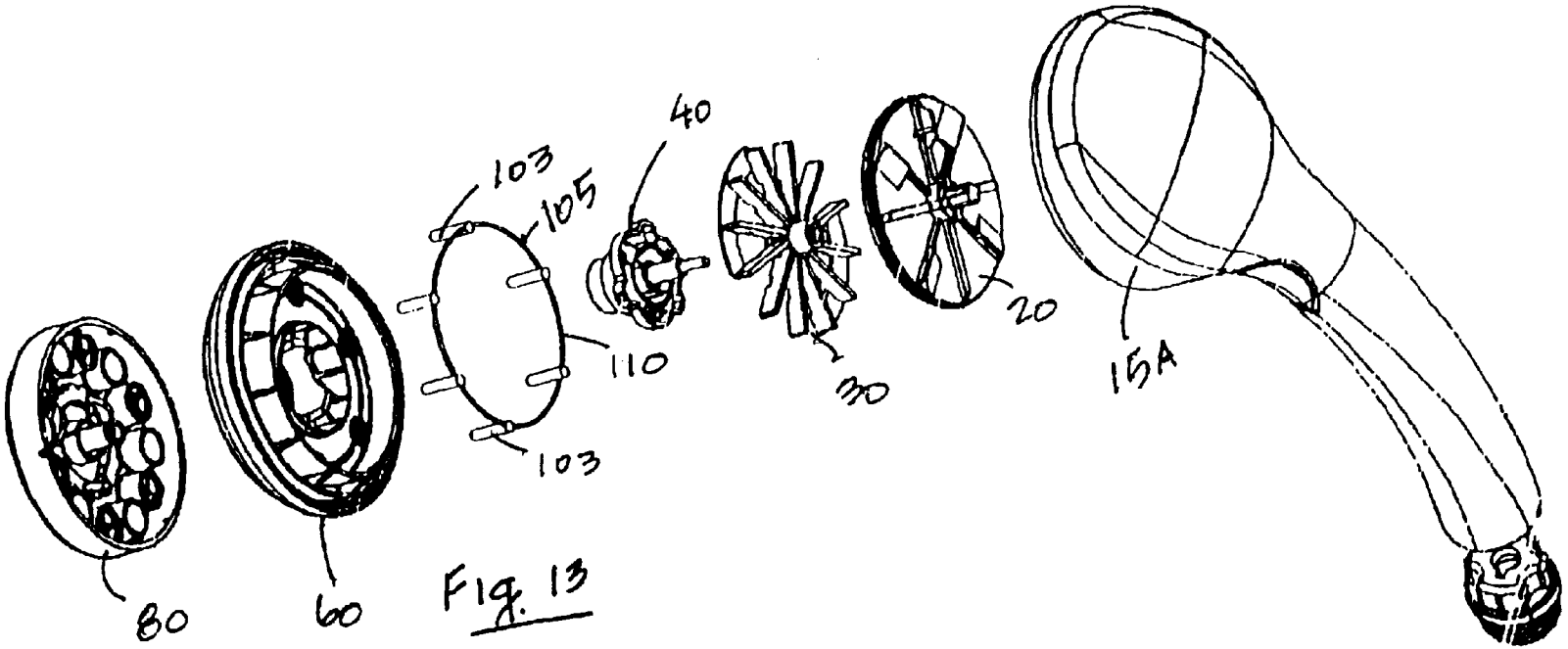
Figure 14:
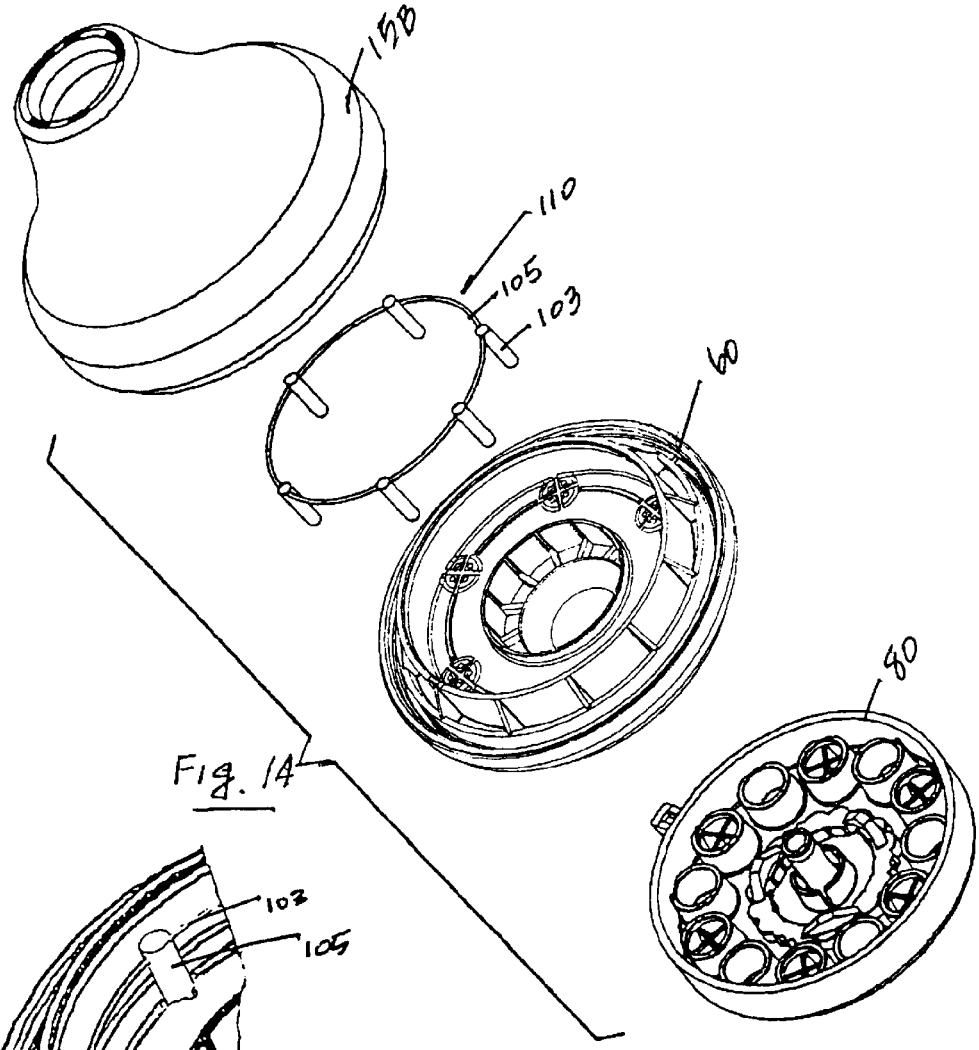
Figure 15:
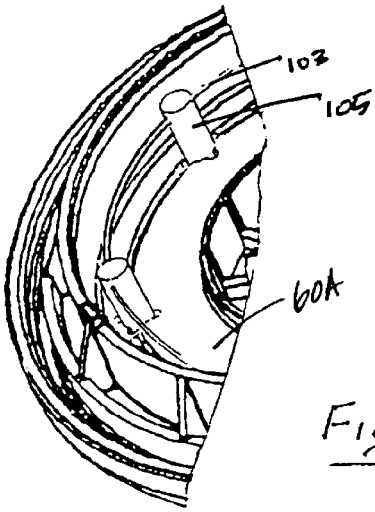
Figure 16A:
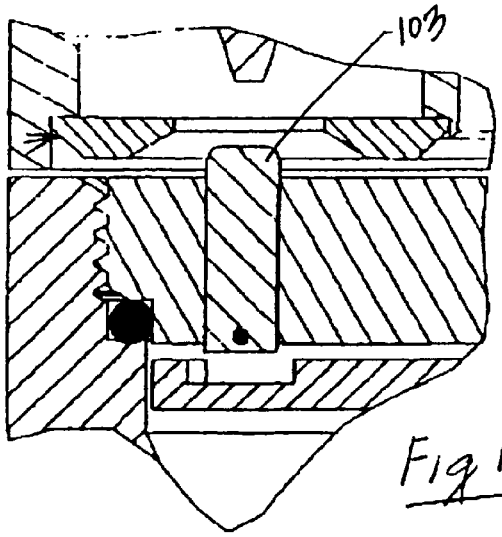
Figure 16B:
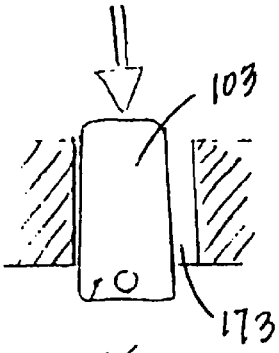
Figure 16C:
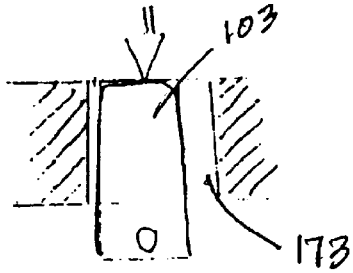
Figure 16D:
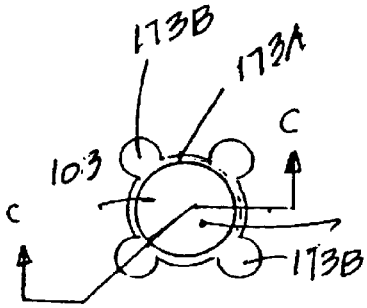

FIG. 1 discloses an exploded perspective view of the preferred embodiment of the showerhead engine assembly of the present invention comprising a stator, a spinner, an engager, an O-ring, a pressure plate, and a faceplate retained within a handle of a hand-held showerhead;

FIG. 2A discloses an exploded perspective view of the downstream surfaces of the engager, the spinner, and the stator of the showerhead engine assembly of FIGS. 1 and 2B discloses an exploded perspective view of the upstream undersurfaces of the engager, spinner, and stator of FIG. 2A;

FIG. 3A discloses a perspective view of the upstream surface of the engager of the showerhead assembly of FIG. 1, and FIG. 3B discloses a perspective view of the downstream surface of the engager of FIG. 3A;

FIG. 4A discloses a perspective view of the upstream surface of the pressure plate of the showerhead assembly of FIG. 1 and FIG. 4B discloses a perspective view of the downstream surface of the pressure plate of FIG. 4A;

FIG. 5A discloses a perspective view of the upstream surface of the faceplate of the showerhead assembly of FIG. 1, and FIG. 5B discloses a perspective view of the downstream surface of the faceplate of FIG. 5A;

FIG. 6 discloses an enlarged side sectional view of the assembly of the engager, pressure plate, and faceplate of FIG. 1;

FIG. 7A discloses a side view of the hand-held showerhead assembly of FIG. 1, and FIG. 7B discloses a front view of the hand-held showerhead assembly of FIG. 1;

FIG. 8A discloses a front view of the faceplate of the showerhead engine assembly of FIG. 7B, the position of the faceplate being between deflected and nondeflected flow relative to the pressure plate;

FIG. 8B discloses a top view of the hand-held showerhead engine assembly of FIG. 8A; and FIG. 8C discloses a bottom view of the hand-held showerhead engine assembly of FIG. 8A;

FIG. 9 discloses an exploded perspective view of a second preferred embodiment of the showerhead engine assembly of the present invention comprising a shell, a stator, a spinner, an engager, an O-ring, a pressure plate, and a faceplate;

FIG. 10A discloses a side view of the showerhead engine assembly of the present invention as used in the fixed showerhead assembly of FIG. 9; and FIG. 10B discloses a side sectional front view of the showerhead engine assembly of FIG. 10A;

FIG. 11A discloses a perspective view of the downstream surface of another preferred embodiment of the faceplate of the showerhead engine assembly of the present invention, the faceplate having two spray selection modes of operation—aeration spray and nondeflected spray;

FIG. 11B discloses a perspective view of the upstream undersurface of the faceplate of FIG. 11A; and FIG. 11C discloses an enlarged detail view of the one of the deflectors of the faceplate of the showerhead assembly of FIG. 11B;

FIG. 12A discloses a perspective view of the upstream surface of another preferred embodiment of the pressure plate of the showerhead engine assembly of the present invention, this preferred embodiment for use with an interchangeable faceplate, the faceplate being shown FIGS. 5A and 5B for a two-piece showerhead engine assembly; and FIG. 12B discloses a perspective view of the downstream undersurface of the pressure plate of FIG. 12A;

FIG. 13 discloses an exploded perspective view of yet another preferred embodiment of the showerhead engine assembly of the present invention, with the showerhead engine assembly of FIG. 1 including a self-cleaning ring that cleans apertures within the pressure plate as the faceplate is rotated relative to the pressure plate;

FIG. 14 discloses an exploded perspective view of still yet another preferred embodiment of the showerhead engine assembly of the present invention, with a two-piece fixed showerhead engine assembly of FIG. 9, and with the self-cleaning ring shown in FIG. 13;

FIG. 15 discloses an enlarged, partial perspective view of the cooperative engagement between the self-cleaning ring and the pressure plate of FIGS. 13 and 14; and FIGS. 16A, 16B, 16C, and 16D show enlarged views of the cooperative engagement between the faceplate and the self-cleaning ring of FIGS. 13 and 14.

DETAILED DESCRIPTION OF THE PREFERRED EMBODIMENTS

Attention is initially drawn to the drawings, as FIG. 1 discloses an assembly view of the preferred embodiment of the hand-held embodiment of the showerhead engine assembly 10A of the present invention. FIGS. 7A, 7B, 8A, 8B, and 8C show additional views of the hand-held showerhead shell and casing 15A. The showerhead engine assembly 10A of the present invention comprises a stator 20, a spinner 30, an engager 40, an O-ring 50, a pressure plate 60, and a faceplate 80.

High-pressure water enters the back end of the showerhead shell of the present invention at between about 20 to 80 psi with a maximum flow of 2.5 gallons/minute @ 80 psi. The water is thrust through the stator 20 and into the spinner 30, passing into and through the pressure plate 60 and is discharged through the faceplate 80. The spinner 30, O-ring 50, and engager 40 are inserted into the pressure plate 60. The stator 20 is snapped into the pressure plate 60 and the faceplate 80 is snapped into the engager. An essentially conventional hand-held shell 15A is used.

Reference is now drawn to FIGS. 2A and 2B which disclose the downstream and upstream surfaces, respectively, of the stator 20, spinner 30, and engager 40.

Water enters the showerhead engine assembly 10A of the present invention tangentially through four evenly-spaced passages 22 disposed at the periphery of the stator 20. Such tangential flow generates a vortex in the pressure chamber within the showerhead engine assembly, causing the spinner 30 to rotate.

The stator 20 is a flat, circular disc. The stator 20 has a centrally disposed stator hub 21 with a centrally disposed orifice 24 for receiving the shaft of the engager 40 therethrough. The stator 20 has eight spokes, the spokes 23 being evenly and symmetrically spaced about the stator hub 21. The spokes 23 extend from the stator hub 21 to the perimeter of the stator 20. Four stator passages 22 are disposed on alternating spokes on the distal half portion of each spoke 23. The stator peripheral passages 22 are defined by and are formed between a flag-shaped raised portion of the essentially flat surface of the stator 20, the stator 20 being sloped in a rearward direction toward the shell 15A. Abutting two of the opposing stator peripheral passages 22 are a pair of flanges 26 extending normal to the plane of the stator 20. The flanges 26 extend from the stator upstream surface 20A and engage the inner surface of the shell 15A. This secures the stator 20 relative to the shell 15 thereby preventing any rotary motion of the stator 20 when the pressurized water enters the showerhead assembly and into the showerhead engine assembly. 10 of the present invention. The stator 20 remains engaged and retained by the shell during all spray selection patterns. The stator 20 also includes a pair of stopping ribs 28 extending from the stator downstream surface 20B. The stopping ribs 28 serve to engage the spinner 30, and block spinner rotation when the spinner 30 is positioned axially in the upstream direction toward the stator 20. The stator ribs 28 are so positioned that when the spinner 30 is restricted from rotation, the pads 37 do not obstruct flow through the stator peripheral passages 22.

The spinner 30 has a circular shape with a centrally disposed spinner hub 32, an opening being disposed in the center of the spinner hub 32. The spinner hub 32 has a generally tubular extension 35, protruding outward from the spinner 30 extending toward the stator 20. The tubular extension 35 nests within the stator hub 25. The spinner 30 preferably has twelve blades 34 extending from the spinner hub 32 to the spinner perimeter, the positioning of the blades 34 being symmetrical and evenly spaced. The blades 34 extend in the axial direction and are so positioned that water entering through the stator passages 22 will propel the blades 34 when the spinner 30 is released from the stator 20 causing a spinning action. The blades 34 are essentially radial except that they are slightly offset from the spinner center, simulating the shape of a spiral. The spiral shape enhances rotation. Two arcuately-shape pads 37 opposing each other extend circumferentially about the perimeter of the spinner 30, each pad 37 joining three of the blades 34 together. The blades 34 are not secured together.

When the spinner 30 is rotating, the pressurized water strikes the pads 37, interrupting water flow. When the pressurized water does not strike the pads 37, flow is continuous. The sequencing of interrupted and uninterrupted flow creates the pulsating effect. The two pads 37 interrupt water flow through the showerhead engine assembly 10A of the present invention, causing the jet streams to have differing velocities, and thereby causing a "massage" action. The pads 37 are so configured that when the spinner 30 is engaged with the stator 20, the spinner being stationary, the pads 37 are not in the path of the water flow, so that all flow is essentially continuous. Either expanding or reducing the number of blades 34 covered by each pad 37 generates other pulsation patterns.

As shown in FIGS. 3A and 3B, the engager 40 includes a stem-like member 42. The engager upstream surface 40A has a center section that forms a central chamber. Centrally disposed and extending in the upstream direction is the stem 42. The stem 42 has a thicker inboard portion 42A for nesting engagement with the spinner hub 32, and a thinner outboard portion 42B for nesting engagement with the stator hub 21. A shoulder 44 is disposed between the stem inboard portion 42A and the stem outboard portion 42B. The shoulder 44 prevents axial movement of the spinner 30. The spinner 30 moves axially with the engager 40 on the stem inboard portion 42A. The stator 20 is secured relative to the shell 15A.

The spinner 30 seats on the thicker inboard portion of the engager stem 42, and the stator 20 seats on the thinner outboard portion 42A of the engager stem 42. In order to minimize the bearing surface of the spinner 30 on the engager 40, a central passageway 31 extends through the spinner 30 and tapers inwardly, preferably on the upstream edge, which results in less of a frictional surface between the engager stem 42 and the spinner 30.

The outer perimeter of the engager 40 is defined by an annulus 48 that surrounds the engager center section 45. The annulus 48 is secured to the engager center section 45 by three radial spokes 46, the engager radial spokes 46 being evenly spaced about the engager 40. The inboard half of each spoke 46 is roughly three times as thick as the outboard half of each engager spoke 46 for purposes of strength. The engager spokes 46 divide the engager perimeter into three outer sections 47, each perimeter section 47 having an arcuate segment of about 120 degrees. Each perimeter section 47 has a centrally disposed nub 50, the nub 50 being less than a forty-five degree sector of each perimeter section 47. The nubs 50 provide the engager 40 with elasticity and improve the secure engagement of the engager 40 with the pressure plate 60.

Centrally disposed within the engager downstream surface 40B is a recess 52 and a middle chamber 56. Three evenly spaced ribs 54 extend radially outward between an inner tubular wall 53 defining the central recess 52 and an outer tubular wall 55 surrounding the middle chamber 56. The ribs 54 divide the middle chamber 56 into three sections, each section having an arcuate segment of about 120 degrees. Each section is aligned with the three perimeter sections 47 of the engager 40.

While the engager 40 is seated within the pressure plate 60, the engager 40 moves axially within the pressure plate 60 with the faceplate 80, the faceplate 80 moving axially with the manual selection of spray patterns. When the engager 40 is repositioned axially toward the shell 15A, the spinner 30 is forced into engagement with the pair of opposing stopping ribs 28 disposed on two opposing blades 34 of the stator 20. This engagement locks the spinner 30 relative to the stator 20. When the engager 40 moves axially downstream with the faceplate 80, the spinner 30 also moves axially toward the faceplate 80 on the engager stem 42, releasing the spinner 30 from the stator 20. This causes the high pressure water to pass between the blades 34 in the spinner 30 causing the spinning action.

The axial force is controlled by the size of the O-ring 50 sealing the engager stem 45A inside the bore in the pressure plate 60. The size of this O-ring 50 and shaft are determined by the size needed to transmit torque between the faceplate 80 and the engager stem 45A.

FIG. 4A shows the pressure plate upstream surface 60, and FIG. 4B shows the pressure plate downstream undersurface 60B. The pressure plate upstream surface 60A cooperatively engages the engager downstream surface 40B, and the pressure plate downstream surface 60B cooperatively engages the faceplate upstream surface 80A.

The pressure plate 60 includes a central opening 64 for receiving the engager outer tubular wall 55. The wall 65 defining the central opening 64 on the pressure plate upstream surface 60A is ramped inwardly and outwardly. The inner section of the pressure plate upstream surface 60A is surrounded by a concentric cylindrical wall 66. The concentric wall 66 surrounds the engager annulus 48 during engagement.

The opening wall 65 is ramped having three each sloped upward segments 61A, flattened top segments 61B, sloped downward segments 61C, and flattened base segments 61D. The length and slope of the sloped upward segments 61A is the same as the length and slope of the sloped downward segments 61C. The length of the flattened top segments 61B is the same as the length of the flattened base segments 61D. The ramps 61 in the opening wall 65 separate the opening wall into six equal sections. Since the engager 40 moves axially and rotationally with the faceplate 80, the ramps 61 cooperatively engage the engager perimeter sections 47. When the engager 40 is in a forward position, the engager spokes 46 are aligned with the flattened base segments 61D, and the ramps 61 nest within the open engager perimeter sections 47. When the engager 40 moves rearward toward the shell 15A, the ramps 61 are aligned with the engager spokes 46 that separate the engager perimeter sections 47.

The midsection of the pressure plate 60 is divided into twelve pie-shaped sections. Alternating sections include a cluster 72 of jet orifices 73 that extend through the pressure plate 60. Each cluster 72 of jet orifices 73 has a box-type configuration. The clusters 72 of jet orifices 73 are positioned on alternating sections. The openings are arranged in two groups of two, an upper group being aligned with and disposed above the lower group. The other alternative sections have no jet orifices. The outer section of the pressure plate upstream surface 60A includes a circumferentially disposed recess 68 sandwiched between two annular flanges 67 and 69 for cooperative engagement with the hand-held showerhead shell 15A.

The hub 62B of the pressure plate downstream surface 60B includes another series of three ramps 71 for cooperative engagement with three ramps 81 on the faceplate upstream surface 80A. Each of the ramps 71 on the pressure plate downstream surface 60B are out of phase and aligned with the ramps 61 on the pressure plate upstream surface 60A. The top portion 71B of each downstream ramp 61 is aligned with a ramp spacing 61D disposed on the pressure plate upstream surface 60A. The ramps 71 on the pressure plate downstream surface 60B have the same shape and configuration as the ramps 81 on the faceplate upstream surface 80A as hereinafter set forth. The hub 62B of the pressure plate 60 and the hub 82 on the faceplate upstream surface 80A are each divided into six equal sections—alternating sections including a ramp (either 71 or 81). The length of the top and bottom ramp sections of the engager 40, pressure plate 60, and faceplate 80 are each sized so that the faceplate 80 and the engager 40 move freely together into the proper axial position as shown in FIGS. 3B, 4A, 4B, and 5A. The relative position of the ramps 71 and 81 moves the faceplate 80 axially relative to the pressure plate 60 during the manual selection of spray patterns. Again, each ramp 71 and 81 includes an upward ramped surface 71A and 81A and a downward ramped surface 71C and 71C. The length of each up-ramped surface 71A and 81A is the same and opposite to the slope of the opposing ramped surface 71C and 81C. The pressure plate downstream surface 60B also includes a cylindrical flange for receiving the faceplate 80.

The central opening 64 of the pressure plate 60 is surrounded by an annular sleeve 68. A plurality of platforms 43 are arcuately positioned about the annular sleeve 68. The pressure plate upstream surface 60A includes a recess 63 disposed between an outer perimeter 67 and an outer rim 69 as shown in FIG. 4A. The recess 63 enables the pressure plate 60 to be securely retained onto the shell 15 of the showerhead. The pressure plate 60 includes a circular lip 70 extending from the pressure plate downstream surface 60B. The lip 70 is concentric with the central passageway 63, and encases the faceplate 80.

The faceplate 80 has a generally cylindrical shape, with a upstream surface 80A as shown in FIG. 5A, and a generally flat downstream surface 80B as shown in FIG. 5B. The faceplate upstream surface 80A includes a center shaft 84 that extends upstream toward the showerhead shell 15A. The center shaft 84 of the faceplate 80 nests within the center portion of the engager 40. Surrounding the shaft is a cylindrical wall having three notches 85. Each notch 85 is evenly spaced and extends from the flat faceplate upstream surface 80A to the distal end of the cylindrical wall. The notches 85 mesh with the engager ribs 54 downstream surface 40B.

The center section of the faceplate upstream surface 80A includes three ramps 81, as already described, for cooperative engagement with the ramps 71 on the pressure plate downstream surface 60B.

The outer section of the faceplate downstream surface 80A includes twelve passages 92 of the same size and shape, each passage 92 being symmetrically spaced about the center shaft along a common circumference. Six of the passages 92A are hollow and unobstructed for nondeflected flow. Alternating passages 92B are divided into four equal quadrants by a pair of crossing portions 93. The outer perimeter of the faceplate upstream surface 80A is a cylindrical flange 88 for retention within the pressure plate 60. The faceplate downstream surface 80B includes convex bubble-shaped deflector surfaces 98 covering the passages 92B. Deflected flow occurs when the bubble-shaped deflector surfaces 98 are aligned with the clusters 72 of jet orifices in the pressure plate 60. Nondeflected flow occurs when the nondeflecting outlet passages 92A are aligned with the clusters 72 of jet orifices in the pressure plate 60. A spray-pattern selector 99 extends radially outward and then rearward from the perimeter of the faceplate 80. The spray-pattern selector 99 enables a secure grasp for repositioning of the faceplate 80 relative to the shell 15 for spray pattern selection. Since the only jet impingement striking the faceplate 80 is through the bubble-shaped deflector surfaces 98, the faceplate 80 only requires attachment to the engager stem 42 with a low force snap fit.

The spacing 81D between each ramp is sufficient to enable ramps on opposing surfaces to nest therebetween during selected spray patterns. The ramps enable (a) the faceplate 80 and the engager 40 to move axially relative to the pressure plate 60, and also (b) the spinner 30 to move axially relative to the stator 20, alternately, engaging and releasing the spinner 30. As the incoming spray alternately is projected through the bubble-shaped deflector surfaces 98 and the nondeflecting passages 92A of the faceplate 80, and the spinner 30 is alternately engaged and released, four distinct spray patterns are enabled.

The pressure chamber is the area between the pressure plate upstream surface 60A and the shell 15A. The spray selection chamber is positioned between the pressure plate downstream surface 60B and the faceplate upstream surface 80A. Water enters the stator 20 at between 12 and 18 psi and leaves the spinner 30 at between 7 and 14 psi and water leaves the pressure plate 60 at atmospheric pressure. The engager 40 acts as an adapter to cooperatively engage the pressure chamber with the spray selection chamber. The O-ring 50 is disposed onto the engager downstream surface 40B, providing a seal between the pressure chamber and the spray selection chamber.

The pressure plate 60 is secured to the shell and does not move in either the axial or rotation positions relative to the shell. Similarly, the stator 20 is engaged with the pressure plate 60 and does not move either axially or rotationally relative to the shell. The faceplate 80 is rotated relative to the shell during manual selection of spray patterns. As the faceplate 80 is rotated relative to the pressure plate 60 during spray pattern selection, the faceplate 80 moves inward and outward axially—one complete rotation includes six inward positions and six outward positions. The faceplate 80 moves axially with alternate position selections, the pattern being A, A, B, B, A, A, B, B, A, A, B, and B for each complete rotation. The hole clusters in the pressure plate 60 are either aligned with the bubble shaped deflector surfaces or the passages disposed between the bubble shaped deflector surfaces, to provide a variety of spray patterns.

The preferred embodiment of the showerhead engine assembly of the present invention as depicted in FIGS. 1 through 8 includes two pulsated positions and two nonpulsated positions. Since the faceplate 80 is divided radially into twelve equal sections, the spray selection pattern is repetitive three times during a complete rotation of the faceplate 80.

As the spray-pattern selector 99 is rotated to select a spray pattern, the axial position of the spinner 30 moves forward and backward relative to the stator 20 as described above.

When the engager perimeter sections 47 are in alignment with the pressure plate ramps 61, the ramps 61 nest with the perimeter sections 47, moving the engager 40 forward relative to the pressure plate 60, and moving the spinner 30 forward relative to the stator 20. Forward movement of the spinner 30 relative to the stator 20 releases the spinner 20 from engagement with the stator stopping ribs 28. With the jets orifices 73 in the pressure plate 60 aligned with the nondeflecting passages 92A in the faceplate 80, the water jets continue in a straight, narrow (nondeflected) spray pattern. By continuing to rotate the faceplate 80 relative to the shell 15, the bubble-shaped deflector surfaces 98 are brought into alignment with the jet orifices 73. This time, the water jets are deflected into a larger spray pattern. During rotation of the spinner 30, the pressurized water entering through the stator peripheral passages 22 is stopped by opposing pads 37 from exiting jet orifices 73 of the plate 60. Rotation of the spinner 30 enables a deflected, pulsating mode and a nondeflecting, pulsating mode.

To operate in the nonpulsating modes, the faceplate 80 is again rotated. The ramps 61 on the pressure plate upstream surface 60A move into alignment with the engager spokes 46. This results in the engager 40 moving backward, bringing the spinner 30 into contact with the stator stopping ribs 28. Such engagement blocks the spinner 30 allowing the water jets to exit the showerhead engine assembly 10 of the present invention in a continuous, uninterrupted spray pattern. With the jets orifices 73 in the pressure plate 60 aligned with the nondeflecting passages 92A in the faceplate 80, the water jets continue undeflected in a straight, narrow spray pattern. By continuing to rotate the faceplate 80 relative to the shell 15, the bubble-shaped deflector surfaces 98 are brought into alignment with the jets orifices 73. This time, the water jets are of a relatively constant velocity and deflect into a larger spray pattern. Once again, the correct alignment is secured by virtue of the detenting action of the engager 40 (which is snap-fit to the faceplate 80) into the pressure plate 60.

The number of seals in the showerhead engine assembly of the present invention is independent of the number of spray patterns. Fewer seals result in fewer sealing surfaces. The pressure ranges in the showerhead engine assembly of the present invention are unique in that the fluid pressure of the water leaving the pressure plate 60 is essentially atmospheric.

Referring now to FIG. 9, an assembly view of a second preferred embodiment of the showerhead engine assembly 10B of the present invention is shown. The showerhead engine assembly 10B is a fixed unit being mounted onto a shell 15B. The showerhead engine assembly comprises a stator 20, a spinner 30, an engager 40, an O-ring 50, a pressure plate 60, and a faceplate 80 identical to the stator 20, spinner 30, engager 40, O-ring 50, pressure plate 60, and faceplate 80 of the first preferred embodiment of the showerhead engine assembly of FIG. 1. The shell 15B is essentially the same as any conventional shell for a fixed showerhead assembly. FIG. 10A discloses a side view of the showerhead shell and casing of FIG. 9; and FIG. 10B discloses a sectional front view of the showerhead engine assembly of FIG. 10A.

The shell 15B is part of the permanent attachment mechanism that is welded to the pressure plate 60, and the shell 15B is affixed directly to the water connection mechanism of the fixed unit shown in FIG. 9. A bushing is threadedly attached to the shell 15B. The shell further includes crossing rods that divide the shower spray into equal quadrants (not shown). Care is taken to prevent any welding at locations other than the main weld. In some instances dissimilar materials are used, such as (acrylonitrile-butadiene-styrene) or Acetal, to limit the weld surface. Alternatively, the spinner 30, engager 40 and stator 20 are assembled onto the pressure plate 60 and the showerhead engine assembly of the present invention is then welded to the shell. Then, the faceplate 80 is pressed onto the engager 40 and the engager 40 is firmly seated against the stator 20.

FIGS. 11A and 11B disclose the downstream and upstream surfaces, respectively, of an alternate embodiment of a faceplate 180 for use with the showerhead engine assembly of the present invention. This faceplate 180 shown provides aerated spray, and nondeflected spray. When used with a spinner and stator, pulsating selection modes can also be provided. This faceplate 180 is compatible with the pressure plate 60, engager 40, spinner 30, and stator 20, and shell of FIG. 1. The aerating flow is at near atmospheric pressure. The aerating flow passages 192B alternate with nondeflected passages 192A and include an inlet head 196 centrally disposed and positioned on the faceplate upstream surface 80A. As shown in FIG. 11C, each inlet head 196 is surrounded by eight spokes 197 radially extending therefrom. The inlet heads 196 and spokes 197 are integral with the flow passages 192B—the spokes 197 do not rotate. The inlet head 196 is dome-shaped. Water jets passing through the pressure plate 60 strike the inlet heads 196, disrupting the water jets while entraining air into the flow passages 192B. The surface tension forces are sufficient to divert the path of the water jets so that they fail to leave the inlet head 196 cleanly and becomes attached to the top face inlet head 196. Once attached to the surface, the water jets tend to remain attached due to surface tension forces (Coanda effect). This occurs when a water jet strikes the convex surface of the inlet head 196, generating internal pressure forces that effectively entrain the water jets towards the surface. The inlet heads 196 can be used with the bubble-shaped deflector surfaces 98 to provide deflected and aerated spray. The inlet heads 196 can also be used with the spinner 30 and stator 20 to provide massaging spray modes.

These water streams are redirected by impinging the jets upon various deflector surfaces disposed within the faceplate 80. These deflector surfaces are positioned within alternating openings in the faceplate 80—an exploded detail view of an aerating deflector surface is shown in FIG. 11C. The water jets pass through an opening and are not deflected or strike a series of deflector surfaces and are redirected, resulting in a more diverse and less directed spray pattern. Spray pattern selection occurs by rotating the faceplate 80 relative to the pressure plate 60. The faceplate 80 is keyed and press fitted to the engager 40. The rotation of this assembly results in the open hole or the deflector surfaces aligned with the jet orifices 73.

FIGS. 12A and 12B disclose another preferred embodiment of a pressure plate 260 for the showerhead engine assembly of the present invention. In this embodiment, the hub portion of the pressure plate 260 has been modified, eliminating ramp features 61 and 71, and including a central boss to receive faceplate boss 84. This pressure plate 260 is compatible with the faceplate 80 of FIG. 5 to form a two-piece assembly. Since connection to the engager is not required, no pressure seal is required, and O-ring 50 can be eliminated. The assembly provides only two modes of operation: (1) nondeflected, and nonpulsated spray; and (2) deflected nonpulsated spray. Again spray selection is made by rotating the faceplate 80 relative to the pressure plate 260. This enables the faceplates and the pressure plates to be interchangeable with similar components in the other assemblies, reducing the number of replacement parts needed for stocking inventory. A detent feature can be included between faceplate 80 and pressure plate 260.

Referring now to FIGS. 13, 14, 15, 16A, 16B, 16C, and 16D, a novel self-cleaning showerhead engine assemble is shown. FIG. 13 discloses an assembly view of a preferred embodiment with the showerhead engine assembly of FIG. 1 including a self-cleaning ring 110 that cleans apertures within the pressure plate 60 as the faceplate 80 is rotated relative thereto. Similarly, FIG. 14 discloses an assembly view of the same self-cleaning ring 110 shown in FIG. 13 with the showerhead engine assembly of FIG. 9.

Six self-cleaning pins 103 are disposed normal to the plane of the spring wire ring 105. The jet orifices 173 now comprise a primary central opening 173A with four smaller openings 173B intersecting the central opening 173A (see FIG. 16D). Each pin 103 of the spring wire ring 105 is positioned in a central opening 173A. The pin 103 is made to translate within the holes 65 by the action of rotation of the shower faceplate 80, resulting in a cleansing action.

As the relative position of the faceplate 80 is rotated about the shell-spring combination as spray selections are made, the edges of the faceplate 80 force the pins 103 to move forward and backward in an axial direction within the jet orifices 173. Both the jet orifice 173 and the pin 103 are tapered and the upward movement of the pin 103 into the jet orifice 173 results in the inside edge of each of jet orifice 173 to be opened and flushed.

FIG. 15 discloses an exploded view of the cooperative engagement between the self-cleaning spring-wire ring and the pressure plate 60 of FIGS. 13 and 14; and FIGS. 16A, 16B, 16C, and 16D show exploded views of the cooperative engagement between the faceplate 80 and the self-cleaning ring of FIGS. 13 and 14.

While the self-cleaning embodiments are shown with the preferred embodiment of FIG. 1 and FIG. 9, one skilled in the art will readily recognize that these principles regarding self-cleaning can be readily applied to all of the other embodiments depicted herein, In addition to being applicable to both hand-held and fixed showerheads, the principles of the present invention are also applicable to other type of shower, nozzle, and sprinkler configurations including lawn sprinklers, dental appliances, and sprinkler systems in manufacturing and process control operations.

It is evident that many alternatives, modifications, and variations of the showerhead engine assembly of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

We claim:

1. A showerhead assembly comprising:

a housing shell;

a stator directing water against a spinner, said spinner selectively rotatable about an axis;

an engager movable along said axis for selectively engaging said spinner;

a pressure plate fixed to said housing comprising a plurality of fluid outlets;

a face plate fixed to said engager and axially moveable with said engager, said face plate rotatable about said axis for selection of a desired spray pattern; and said pressure plate comprises several ramped portions cooperating with a surface of said engager and said face plate for moving said engager and said face plate axially.

2. The assembly of claim 1, wherein said ramped portions are disposed radially within said pressure plate.

3. The assembly of claim 2, wherein said pressure plate includes a first side corresponding to said faceplate and a second side corresponding to said engager, said first and second sides including said ramped portions.

4. The assembly of claim 1, wherein said face plate includes a plurality of non-deflecting openings and a plurality of deflecting openings.

5. The assembly of claim 1, wherein said spinner rotates about said axis to intermittently block flow through said pressure plate creating a pulsating water stream through said pressure plate.

6. The assembly of claim 1, wherein said pressure plate includes a plurality of jet orifice clusters disposed radially about said axis.

7. The assembly of claim 6, wherein each of said jet orifice clusters comprises four jet orifices.

8. The assembly of claim 1, wherein said engager includes an outer circumference including at least one nub corresponding with an inner surface of said pressure plate for positively locating said engager relative to said pressure plate.

9. The assembly of claim 8, wherein said positive location between said nub and said inner surface corresponds to alignment of an opening within said face plate with said pressure plate.

10. The assembly of claim 1, wherein said spinner comprises a hub supported on a stem of said engager, said spinner including a plurality of arms extending radially outward from said hub.

11. The assembly of claim 10 including a pad spanning radially across at least two of said plurality of arms, said pads interrupt water flow to create a pulsating effect.

12. The assembly of claim 1, wherein said stator is a flat disc having a plurality of passages disposed about an outer circumference of said stator.

13. The assembly of claim 12, wherein said stator includes at least a central hub receiving said stan of said engager.

14. The assembly of claim 12, wherein said stator includes at least one stopping rib for contacting and stopping rotation of said spinner.

* * * * *

UNITED STATES PATENT AND TRADEMARK OFFICE

CERTIFICATE OF CORRECTION

PATENT NO. : 6,715,699 B1
DATED : April 6, 2004
INVENTOR(S) : Greenberg et al.

It is certified that error appears in the above-identified patent and that said Letters Patent is hereby corrected as shown below:

Column 14,
Line 5, “stan” should read as -- stem --

Signed and Sealed this

Twenty-second Day of June, 2004

JON W. DUDAS
*Acting Director of the United States Patent and Trademark Office*